US011015821B2

(12) United States Patent
Dong et al.

(10) Patent No.: US 11,015,821 B2
(45) Date of Patent: May 25, 2021

(54) METHOD AND DEVICE FOR CONTROLLING PHOTOVOLTAIC AIR CONDITIONING SYSTEM

(71) Applicant: Gree Electric Appliances, INC. of Zhuhai, Guangdong (CN)

(72) Inventors: Mingzhu Dong, Guangdong (CN); Zhigang Zhao, Guangdong (CN); Shiyong Jiang, Guangdong (CN); Chongyang Feng, Guangdong (CN); Jiangxi Song, Guangdong (CN); Xuefen Zhang, Guangdong (CN); Keqin Liu, Guangdong (CN); Jing Wang, Guangdong (CN)

(73) Assignee: Gree Electric Appliances, INC. of Zhuhai

( * ) Notice: Subject to any disclaimer, the term of this patent is extended or adjusted under 35 U.S.C. 154(b) by 0 days.

(21) Appl. No.: 15/779,300

(22) PCT Filed: Oct. 25, 2016

(86) PCT No.: PCT/CN2016/103203
§ 371 (c)(1),
(2) Date: May 25, 2018

(87) PCT Pub. No.: WO2017/092518
PCT Pub. Date: Jun. 8, 2017

(65) Prior Publication Data

US 2018/0347834 A1 Dec. 6, 2018

(30) Foreign Application Priority Data

Nov. 30, 2015 (CN) ..... 201510862472.2

(51) Int. Cl.
*F24F 5/00* (2006.01)
*F24F 11/88* (2018.01)
(Continued)

(52) U.S. Cl.
CPC ..... *F24F 5/0046* (2013.01); *F24F 11/30* (2018.01); *F24F 11/46* (2018.01); *F24F 11/63* (2018.01);
(Continued)

(58) Field of Classification Search
CPC ..... F24F 5/0046; F24F 2005/0064; F24F 2005/0067; F24F 11/30; F24F 5/00; H02J 9/06
See application file for complete search history.

(56) References Cited

U.S. PATENT DOCUMENTS 5,726,561 A 3/1998 Ghosh et al.
9,870,016 B2 * 1/2018 Adest ..... H02J 3/385
(Continued)

FOREIGN PATENT DOCUMENTS

CN 101162871 A 4/2008
CN 101886840 A 11/2010
(Continued)

OTHER PUBLICATIONS

New Zealand Intellectual Property Office, First Examination Report for Application No. 742591, dated Oct. 19, 2018.
(Continued)

*Primary Examiner* — Tho V Duong
(74) *Attorney, Agent, or Firm* — Honigman LLP; Matthew H. Szalach; Jonathan P. O'Brien

(57) ABSTRACT

A method for controlling a photovoltaic air conditioning system. The method comprises: detecting a grid frequency (101); when the detected grid frequency is not equal to a pre-set frequency, calculating and obtaining a control parameter according to the detected grid frequency (102); and controlling a photovoltaic air conditioning by means of the calculated and obtained control parameter (103). Also disclosed is a photovoltaic air conditioning control device.

13 Claims, 3 Drawing Sheets

(51) Int. Cl.

| | |
|---|---|
| ***F24F 11/63*** | (2018.01) |
| ***F24F 11/46*** | (2018.01) |
| ***F24F 11/30*** | (2018.01) |
| *F24F 11/89* | (2018.01) |

(52) U.S. Cl.
CPC ..... *F24F 11/88* (2018.01); *F24F 11/89* (2018.01); *F24F 2005/0067* (2013.01)

(56) References Cited

U.S. PATENT DOCUMENTS

| | | | | |
|---|---|---|---|---|
| 2010/0213763 | A1* | 8/2010 | Boss | H02J 9/06 307/29 |
| 2011/0125335 | A1* | 5/2011 | Boss | G06F 1/26 700/286 |
| 2013/0073109 | A1* | 3/2013 | Cheng | H02J 3/40 700/298 |
| 2013/0214718 | A1* | 8/2013 | Ikeda | G05B 11/42 318/609 |
| 2014/0246925 | A1* | 9/2014 | Porter | H02J 3/14 307/115 |
| 2015/0211757 | A1 | 7/2015 | Mutchnik et al. | |
| 2015/0369525 | A1* | 12/2015 | Hsieh | H02M 3/155 62/235.1 |

FOREIGN PATENT DOCUMENTS

| | | | | |
|---|---|---|---|---|
| CN | 102355776 | A | | 2/2012 |
| CN | 102412606 | A | | 4/2012 |
| CN | 102486330 | A | | 6/2012 |
| CN | 102890173 | A | | 1/2013 |
| CN | 103178533 | A | | 6/2013 |
| CN | 203586455 | U | * | 5/2014 |
| CN | 203984305 | U | | 12/2014 |
| CN | 104283302 | A | | 1/2015 |
| CN | 104993490 | A | | 10/2015 |
| CN | 105048512 | A | | 11/2015 |
| CN | 105387569 | A | | 3/2016 |
| JP | 2004129357 | A | | 4/2004 |
| JP | 2009168296 | A | | 7/2009 |
| KR | 20030043466 | A | | 6/2003 |

OTHER PUBLICATIONS

State Intellectual Property Office (P.R.C.), First Office Action for Application No. 201510862472.2, dated Sep. 30, 2017.
European Patent Office, Extended European Search Report for EP Application No. 16869828.0, dated Jul. 4, 2019.
State Intellectual Property Office (P.R.C.), International Search Report for Application No. PCT/CN2016/103203, dated Jan. 13, 2017.
India Intellectual Property Office, First Office Action for Application No. 201817018590, dated Sep. 11, 2020.

* cited by examiner

METHOD AND DEVICE FOR CONTROLLING PHOTOVOLTAIC AIR CONDITIONING SYSTEM

CROSS-REFERENCE TO RELATED APPLICATIONS

This application is the national phase of International Application No. PCT/CN2016/103203, filed Oct. 25, 2016, which claims priority to Chinese Patent Application No. 201510862472.2, titled "METHOD AND DEVICE FOR CONTROLLING PHOTOVOLTAIC AIR CONDITIONING SYSTEM", filed on 30 Nov. 2015 with the State Intellectual Property Office of People's Republic of China, the disclosures of which are incorporated herein by reference in their entirety.

FIELD

The present disclosure relates to the technical field of mechanical control, and in particular, to a method and a device for controlling a photovoltaic air conditioning system.

BACKGROUND

A photovoltaic air conditioner is a new air conditioner that utilizes solar energy, which includes a solar collector for providing hot water as heat medium to a generator of an absorption refrigerator. A higher temperature of the hot water as heat medium results in a high coefficient of performance (COP) of the refrigerating machine and a higher refrigerating efficiency of the air-conditioning system. For example, in a case that the hot water as heat medium has a temperature about 60 degree Celsius, the COP of the refrigerating machine is about 0~40; in a case that the hot water as heat medium has a temperature about 90 degree Celsius, the COP of the refrigerating machine is about 0~70; and in a case that the hot water as heat medium has a temperature about 120 degree Celsius, the COP of the refrigerating machine may be more than 110.

Currently, photovoltaic air conditioner have been exported all over the world, while parameters of different national grids are different. A conventional photovoltaic air conditioner is generally drove and controlled to be grid-connected based on a local grid parameter, and thus cannot be operated in a stable environment in other countries.

For the above problems, no effective solutions have been provided.

SUMMARY

A method for controlling a photovoltaic air conditioning system is provided according to embodiments of the present disclosure, so as to broaden a range of application for the air conditioner. The method includes: detecting a grid frequency; calculating a control parameter based on the detected grid frequency in a case where the detected grid frequency is not equal to a preset frequency; and controlling a photovoltaic air conditioner based on the calculated control parameter.

In an embodiment, the control parameter includes: a PI control parameter and a filter parameter.

In an embodiment, the detecting the grid frequency includes: controlling the photovoltaic air conditioner to enter an interrupt status; acquiring an interval between two adjacent interrupts and determining the interval as a grid phase angle period; and calculating the grid frequency based on the grid phase angle period.

In an embodiment, the calculating the grid frequency based on the one grid phase angle period includes: acquiring a reciprocal of the grid phase angle period; determining the acquired reciprocal as the grid frequency.

In an embodiment, the preset frequency is 50 Hz.

In an embodiment, where before the detecting a grid frequency, the method further includes: setting the control parameter for the photovoltaic air conditioner at a grid frequency of 50 Hz; controlling the photovoltaic air conditioner based on the control parameter for the photovoltaic air conditioning at the grid frequency of 50 Hz in a case where the detected grid frequency is equal to the preset frequency.

An apparatus for controlling a photovoltaic air conditioner is further provided in the embodiment of the present disclosure to increase a usage range of the air conditioner. The apparatus includes: a detection module, configured to detect a grid frequency; a calculation module, configured to calculate a control parameter based on the detected grid frequency in a case where the detected grid frequency is not equal to a preset frequency; and a control module, configured to control a photovoltaic air conditioner based on the calculated control parameter.

In an embodiment, the detection module includes: an interrupt unit, configured to control the photovoltaic air conditioner to enter an interrupt status; an interval acquiring unit, configured to acquire an interval between two adjacent interrupts and determine the interval as a grid phase angle period; and a calculation unit, configured to calculate the grid frequency based on the grid phase angle period.

In an embodiment, the calculation unit includes: a reciprocal acquiring subunit, configured to acquire a reciprocal of the grid phase angle period; and a determination subunit, configured to determine the acquired reciprocal as the grid frequency.

In an embodiment, the preset frequency is 50 Hz.

In the above embodiments, the preset frequency is set in advance. The preset frequency is a factory preset frequency for the air conditioner. After connecting to the grid, the grid frequency of the grid in which the air conditioner is located is detected. In a case where it is detected that the grid frequency is different from the preset frequency, the control parameter of the air conditioner is calculated based on the detected preset frequency, so that the control parameters can match with the grid frequency. This solution addresses the technical issue of a control deviation caused by improper setting of the control parameter in the conventional art, and thereby achieving an effective control of air conditioner.

BRIEF DESCRIPTION OF THE DRAWINGS

The accompanying drawings described herein are used for providing a further understanding of the present disclosure and constitute a part of this disclosure. The exemplary embodiments of the present disclosure and descriptions thereof are used for explaining the present disclosure but do not constitute a limit to the present disclosure. In the accompanying drawings.

DETAILED DESCRIPTION OF EMBODIMENTS

To make objectives, technical solutions and advantages of the present disclosure clearer, the present disclosure will be described in detail hereinafter in conjunction with the embodiments and the drawings. The schematic embodiments of the present disclosure and its description are for explaining the disclosure and thus do not limit the present disclosure.

The conventional photovoltaic air conditioner cannot be used in various countries, since the air conditioner can not recognize a grid frequency of a grid where the air conditioner is located. A grid-connected driving control parameter of the air conditioner are fixed. For those reason, the inventor found out that the grid frequency of the grid where the air conditioner is located can be recognized, so that a filter parameter and a PI control parameter may be changed based on the recognized grid frequency after recognizing the grid frequency of the grid, thereby addressing an issue in the conventional art that a controlling deviation is caused by a variables deviation which is a result of that an interference cannot be filtered due to an improper filter parameter, and an issue in the conventional art that the air conditioning system has a poor response and even an oscillation due to a PI control parameter deviation.

Figure 1:
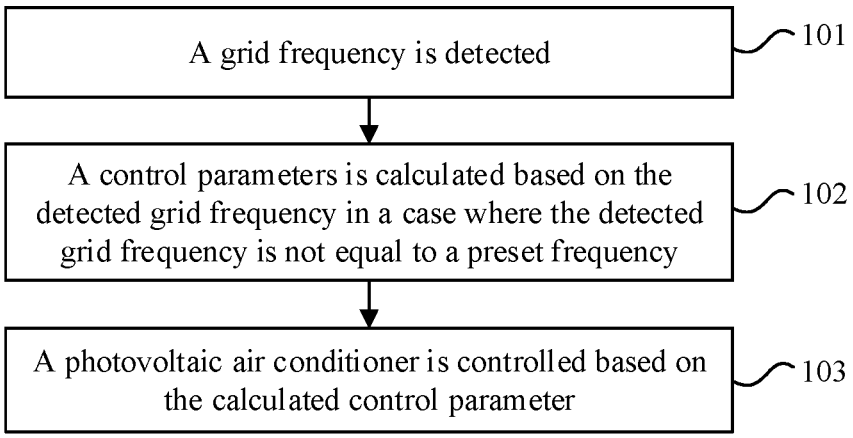
FIG. 1 is a method flow diagram of a method for controlling a photovoltaic air conditioning system according to an embodiment of the present disclosure.

As shown in FIG. 1, a method for controlling a photovoltaic air conditioning system provided in the embodiment includes following step 101 to step 103.

In step 101, a grid frequency is detected.

In step 102, a control parameter is calculated based on the detected grid frequency in a case where the detected grid frequency is not equal to a preset frequency.

In step 103, a photovoltaic air conditioner is controlled based on the calculated control parameter.

In the above embodiment, the preset frequency is set in advance. The preset frequency is a factory preset frequency for the air conditioner. After connecting to the grid, the grid frequency of the grid in which the air conditioner is located is detected. In a case where it is detected that the grid frequency is different from the preset frequency, the control parameter of the air conditioner is calculated based on the detected preset frequency, so that the control parameters can match with the grid frequency. This solution addresses the technical issue of a control deviation caused by improper setting of the control parameter in the conventional art, and thereby achieving an effective control of air conditioner.

The control parameter that may be affected by the grid frequency may include a PI control parameter and a filter parameter. Therefore, the control parameter that is generated after determining the grid frequency may include the PI control parameter and the filter parameter, where the PI control parameter may include Kp (proportion coefficient) and Ki (integral coefficient), and the filter parameter may include a filter parameter vector group F.

In order to detect the grid frequency without adding an additional frequency detection circuit, the grid frequency may be detected by a frequency recognizing method using a phase angle of grid voltage, that is, by determining the grid frequency by obtaining a reciprocal of a grid phase angle period. The frequency recognizing method which does not need the additional frequency detection circuit, is different from a zero-cross method and has a simple algorithm and a short delay. The frequency recognizing method can quickly detect the grid frequency of the grid where the air conditioner is located. Specifically, the detecting the grid frequency may be performed by following steps. The photovoltaic air conditioner is controlled to enter an interrupt status; an interval between two adjacent interrupts is acquired and determined as the grid phase angle period; the grid frequency is calculated based on the grid phase angle period, that is, a reciprocal of one grid phase angle period is acquired and the acquired reciprocal is determined as the grid frequency.

Considering that a voltage of the mains supply is generally 220V, and a corresponding frequency is generally 50 Hz, the preset frequency of the air conditioner may be set as 50 Hz, so as to reduce a probability of changing the frequency. Furthermore, in a case where the preset frequency is 50 Hz, the control parameter should also be preset for the photovoltaic air conditioner at 50 Hz. Correspondingly, in a case where the detected grid frequency is equal to the preset frequency, the photovoltaic air conditioner is controlled based on the control parameters of the photovoltaic air conditioner at the grid frequency of 50 Hz.

The above method address an issue of a bad effect and even an unstable grid-connected driving operation due to different grid environments in the conventional art, thereby effectively increasing a range of product application. In addition, a driver board does not need to be changed according to the different markets. One driver board may be suitable for all markets, which is convenient and may reduce the cost.

A specific embodiment is further provided in the present disclosure to describe the method for controlling the photovoltaic air conditioning system. It should also be noted that the specific embodiments is only for a better understanding of the present disclosure, and does not limit the present disclosure.

Figure 2:
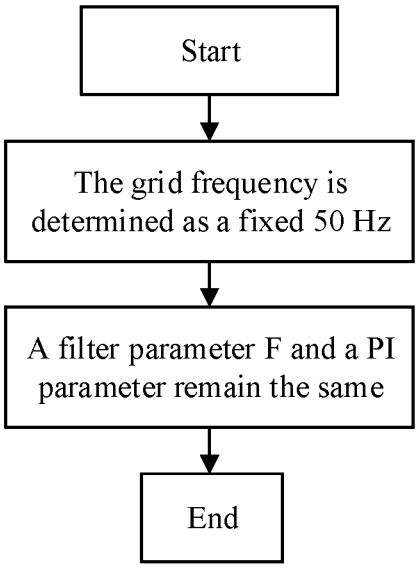
Figure 2 (Prior Art)
FIG. 2 is a flow diagram of a conventional grid-connected control technology.

FIG. 2 is a flow diagram of a conventional grid-connected controlling technology. It can be seen from FIG. 2 that this controlling technology always determines the grid frequency of the grid where the air conditioner is located as 50 Hz, regardless of changes to the grid environment. It is assumed that the PI control parameter include Kp, Ki and filter parameter vector group F, where Kp, Ki, and F each is a function associated with the grid frequency f, that is, Kp=f1(f), Ki=f2(f) and F=f3(f). In a case that there is a change to the grid, and in a case that the grid frequency is regarded as unchanged, the Kp, Ki, and F remain the same, thereby resulting in a mismatch between the filter parameters, the PI parameters and the current grid. In the case of a mismatch of the filter parameter, harmonic interference cannot be effectively filtered, thereby resulting in an error of the variables, a control deviation and an imprecise control of the system. In the case of a mismatch or a deviation of the PI control parameters, a system response may be poor, and even an oscillation may be generated, thereby resulting in abnormal operation of the system.

A method for controlling a photovoltaic air conditioning system is provided. The main idea is to detect the grid frequency, then to change the parameters Kp, Ki and F so as to adapt to the grid environment in a case the frequency changes.

Figure 3:
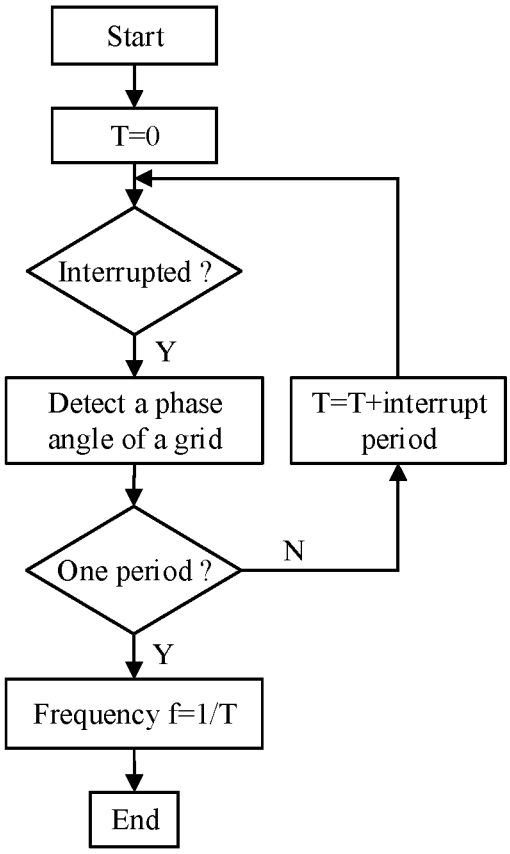
FIG. 3 is a flow diagram of a frequency detection according to an embodiment of the present disclosure.

FIG. 3 is a flow diagram of a frequency detection, in which an additional frequency detection circuit is not added. A value of T in a program is assigned to be 0. In a case of an interrupt, it is determined whether it is one grid phase angle period. In a case where it is determined that T is not one grid phase angle period, T=T+interrupt period; and in a case where it is determined that T is one grid phase angle period, the grid frequency f=1/T.

Figure 4:
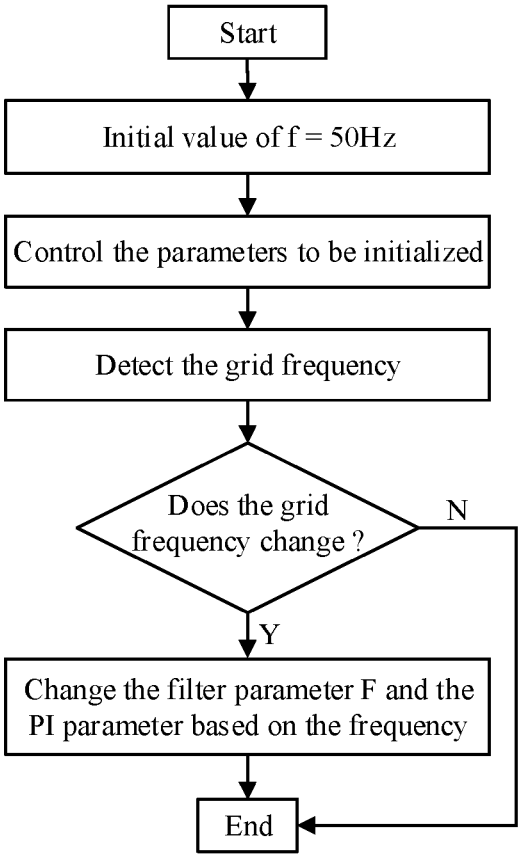
FIG. 4 is a schematic diagram of self-adaptively parameters adjusting according to an embodiment of the present disclosure.

FIG. 4 is a schematic diagram of self-adaptively parameters adjusting. After detecting the frequency f, it is determined whether the frequency f is equal to a preset frequency (i.e. 50 Hz). In a case that the frequency f is equal to the preset frequency, the parameters Kp, Ki and F remain the same; and in a case that the frequency f is not equal to the preset frequency, the parameters Kp, Ki and F are changed based on formulas Kp=f1(f), Ki=f2(f), F=f3(f), so that the grid-connected driving control parameters can be adjusted quickly and the air conditioner can stably operate in the grid environment where the air conditioner is located, thereby broadening a range of application. The driver board can be unchanged in this method, workloads and production costs can be saved.

In the above embodiment, by quickly recognizing the grid frequency of the grid where the air conditioner is located and adjusting the filter parameter and the PI parameter, the grid-connected driving can be widely adapted to various national grid environment. First, the grid frequency recognition is performed by recognizing the frequency using a phase angle of grid voltage (i.e., the reciprocal of an electrical angle period). The frequency recognizing method which does not need the additional frequency detection circuit, is different from a zero-cross method and has a simple algorithm and a short delay The frequency recognizing method can quickly detect the grid frequency of the grid where the air conditioner is located. Secondly, by detecting the grid frequency of the grid where the air conditioner is located and based on formulas between the filter parameter, the PI control parameter and the grid frequency, the above parameters can be adjusted. The grid-connected driving can quickly change the control parameter according to the grid environment and thus achieving a smooth running.

Figure 5:
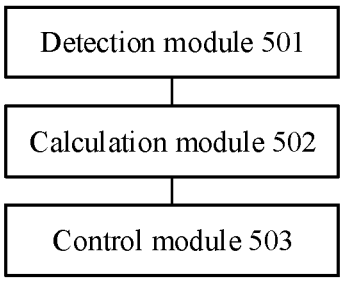
FIG. 5 is a structural block diagram of an apparatus for controlling a photovoltaic air conditioning system according to an embodiment of the present disclosure.

Based on the same inventive concept, an apparatus for controlling a photovoltaic air conditioning system is further provided and described in an embodiment of the present disclosure. Since the principles for addressing the issues in the apparatus for controlling the photovoltaic air conditioning system is similar to the method for controlling the photovoltaic air conditioning system, the apparatus for controlling the photovoltaic air conditioning system may refer to the method for controlling the photovoltaic air conditioning system for implementation, and details are not described herein. Terms "unit" or "module" may refer to a combination of software and/or hardware for achieving predetermined functions. Although the apparatus described in the following embodiments are better implemented by software, the implementation of the hardware, or the combination of software and hardware, are also possible and conceived. FIG. 5 is a structural block diagram of a method for controlling a photovoltaic air conditioning system according to an embodiment of the present disclosure. As shown in FIG. 5, the apparatus may include a detection module 501, a calculation module 502 and a control module 503, the structure is described hereinafter.

The detection module 501 is configured to detect a grid frequency;

The calculation module 502 is configured to calculate a control parameter based on the detected grid frequency in a case where the detected grid frequency is not equal to a preset frequency.

The control module 503 is configured to control a photovoltaic air conditioner based on the calculated control parameters.

In an embodiment, the detection module 501 may include an interrupt unit, an interval acquiring unit and a calculation unit. The interrupt unit is configured to control the photovoltaic air conditioner to enter an interrupt status. The interval acquiring unit is configured to acquire an interval between two adjacent interrupts and determine the interval as a grid phase angle period. The calculation unit is configured to calculate the grid frequency based on the grid phase angle period.

In an embodiment, the calculation unit may include: a reciprocal acquiring subunit and a determination subunit. The reciprocal acquiring subunit is configured to acquire a reciprocal of the grid phase angle period. The determination subunit is configured to determine the acquired reciprocal as the grid frequency.

In an embodiment, the preset frequency may be 50 Hz.

It can be seen from the above description that the embodiments of the present disclosure achieve the following technical effects. The preset frequency is set in advance. The preset frequency is a factory preset frequency for the air conditioner. After connecting to the grid, the grid frequency of the grid in which the air conditioner is located is detected. In a case where it is detected that the grid frequency is different from the preset frequency, the control parameter of the air conditioner is calculated based on the detected preset frequency, so that the control parameters can match with the grid frequency. This solution addresses the technical issue of a control deviation caused by improper setting of the control parameter in the conventional art, and thereby achieving an effective control of air conditioner.

It should be understood by those skilled in the art that the modules or steps according to the above embodiments of the present disclosure may be implemented by a general computing apparatus. The modules or steps can be integrated in a single computing apparatus or be distributed on a network consisting of multiple computing apparatus. Optionally, the modules or steps can be implemented by the computing apparatus executing a program, so that they can be stored in a storage device and performed by the computing apparatus. In some cases, the steps shown or described hereinbefore may be performed in a different sequence, or may be implemented by multiple integrated circuit modules respectively, or may be implemented by a single integrated circuit module that combining multiple modules or steps. Thus, the embodiments of the disclosure are not limited to any particular combination of hardware and software.

The above descriptions are merely preferred embodiments of the disclosure, and are not intended to limit the disclosure. Those skilled in the art may make various modifications and changes to the embodiment of the present disclosure. All such modifications, equivalent substitutions and improvements without departing from spirit and principle of the present invention fall in the protection scope of the present invention.

The invention claimed is:

1. A method for controlling a photovoltaic air conditioning system, comprising:

detecting a grid frequency f;

determining whether the detected grid frequency f is equal to a preset frequency;

maintaining a control parameter unchanged in a case that the detected grid frequency f is equal to the preset frequency, wherein the control parameter comprises a PI control parameter and a filter parameter, the PI control parameter comprises a proportion coefficient Kp and an integral coefficient Ki, and the filter parameter comprises a filter parameter vector group F;

calculating the control parameter based on the detected grid frequency according to Kp=f1(f), Ki=f2(f) and F=f3(f), in a case where the detected grid frequency is not equal to the preset frequency; and controlling a photovoltaic air conditioner based on the calculated control parameter, wherein the step of controlling a photovoltaic air conditioner based on the calculated control parameter further comprises:

controlling a grid-connected driving control parameter of the photovoltaic air conditioner.

2. The method according to claim 1, wherein the detecting a grid frequency comprises:

controlling the photovoltaic air conditioner to enter an interrupt status;

acquiring an interval between two adjacent interrupts; determining the interval as a grid phase angle period; and calculating the grid frequency based on the grid phase angle period.

3. The method according to claim 2, wherein the calculating the grid frequency based on the grid phase angle period comprises:

acquiring a reciprocal of the grid phase angle period; and determining the acquired reciprocal as the grid frequency.

4. The method according to claim 1, wherein the preset frequency is 50 Hz.

5. The method according to claim 4, wherein before the detecting a grid frequency, the method further comprises:

setting the control parameter for the photovoltaic air conditioner at a grid frequency of 50 Hz; and controlling the photovoltaic air conditioner based on the control parameter for the photovoltaic air conditioner at the grid frequency of 50 Hz in a case where the detected grid frequency is equal to the preset frequency.

6. An apparatus for controlling a photovoltaic air conditioner, comprising:

a detection module, configured to detect a grid frequency f;

a determining module, configured to determine whether the detected grid frequency f is equal to a preset frequency;

a calculation module, configured to:

maintain a control parameter unchanged in a case that the detected grid frequency f is equal to the preset frequency, wherein the control parameter comprises a PI control parameter and a filter parameter, the PI control parameter comprises a proportion coefficient Kp and an integral coefficient Ki, and the filter parameter comprises a filter parameter vector group F; and calculate the control parameter based on the detected grid frequency according to Kp=f1(f), Ki=f2(f) and F=f3(f), in a case where the detected grid frequency is not equal to the preset frequency; and a control module, configured to control a grid-connected driving control parameter of a photovoltaic air conditioner based on the calculated control parameter.

7. The apparatus according to claim 6, wherein the detection module comprises:

an interrupt unit, configured to control the photovoltaic air conditioner to enter an interrupt status;

an interval acquiring unit, configured to acquire an interval between two adjacent interrupts and determine the interval as a grid phase angle period; and a calculator, configured to calculate the grid frequency based on the grid phase angle period.

8. The apparatus according to claim 7, wherein the calculator comprises:

a reciprocal acquiring subunit, configured to acquire a reciprocal of the grid phase angle period; and a determination subunit, configured to determine the acquired reciprocal as the grid frequency.

9. The apparatus according to claim 6, wherein the preset frequency is 50 Hz.

10. The apparatus according to claim 7, wherein the preset frequency is 50 Hz.

11. The apparatus according to claim 8, wherein the preset frequency is 50 Hz.

12. The method according to claim 2, wherein the preset frequency is 50 Hz.

13. The method according to claim 3, wherein the preset frequency is 50 Hz.

* * * * *